US007207869B2

(12) United States Patent
James

(10) Patent No.: US 7,207,869 B2
(45) Date of Patent: Apr. 24, 2007

(54) APPARATUS FOR SUPPORTING AIRFOILS IN A GRIT BLASTING PROCESS

(75) Inventor: Jerome James, Burkburnett, TX (US)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 53 days.

(21) Appl. No.: 11/064,237

(22) Filed: Feb. 22, 2005

(65) Prior Publication Data

US 2006/0189265 A1 Aug. 24, 2006

(51) Int. Cl.
*B24C 3/20* (2006.01)

(52) U.S. Cl. ..... 451/82; 451/84; 451/413; 451/414

(58) Field of Classification Search ..... 451/75, 451/80, 82, 84, 385, 387, 397, 398, 402, 451/405, 413, 414
See application file for complete search history.

(56) References Cited

U.S. PATENT DOCUMENTS 919,417 A 4/1909 Carroll
1,713,695 A 5/1929 Hull
3,595,504 A * 7/1971 Anderson et al. ..... 248/515
4,084,357 A 4/1978 Moses
4,662,125 A 5/1987 Brenner et al.
4,738,056 A 4/1988 Suzuki
4,753,051 A 6/1988 Tano et al.
5,641,179 A * 6/1997 Imlach ..... 280/770
6,120,364 A 9/2000 Laflamme
6,520,838 B1 2/2003 Shaw
6,609,950 B2 8/2003 Kimura et al.
6,669,535 B1 12/2003 Welty
6,726,548 B1 4/2004 Williams
6,765,219 B2 * 7/2004 Berrian et al. ..... 250/492.21
6,966,817 B2 * 11/2005 Tang et al. ..... 451/5

* cited by examiner

*Primary Examiner*—Jacob K. Ackun, Jr.
(74) *Attorney, Agent, or Firm*—Ogilvy Renault LLP

(57) ABSTRACT

An apparatus provided for supporting at least one component in a grit blasting process comprises a base and a platform table assembly mounted to the base. The platform table assembly includes a platform table therein which is rotatable and angularly adjustable with respect to the base. The platform table includes a component holding device for releasably holding the at least one component in position during the grit blasting process.

15 Claims, 3 Drawing Sheets

APPARATUS FOR SUPPORTING AIRFOILS IN A GRIT BLASTING PROCESS

FIELD OF THE INVENTION

The present invention relates generally to metal machining processes and more specifically to an apparatus for supporting components in a grit blasting process.

BACKGROUND OF THE INVENTION

A gas turbine engine includes various compressor and turbine stator vanes, and rotor blades. The vanes and blades have airfoil profiles specifically configured for use in compressing air or expanding hot combustion gases. The airfoil profiles have three-dimensional contours which vary from root to tip between leading and trailing edges over the opposite pressure and suction sides thereof. The airfoil has a cambered or arcuate curvature between its leading and trailing edges, with the pressure side typically being generally concave and the suction side being generally convex.

The airfoils may be made by various manufacturing processes. The varying machining processes result in undesirable small grooves and sharp ridges as metal material around the circumference of the airfoil is removed. After the machining process, a polishing process must be conducted to obtain an aerodynamically smooth surface finish without irregularities. During a polishing process such as a grit blasting process, the airfoils are placed in a grit blast cabinet. Conventionally, a supporting tool is used to load one or more airfoils thereon and is placed together with the loaded airfoils in the cabinet. The supporting tool is operative within the cabinet for convenience of the grit blasting process. Considering the number of airfoils to be processed and the productivity thereof, it is desirable that the supporting tool should be configured for easy loading and unloading of the airfoils thereonto and therefrom. It is also desirable to configure the supporting tool for easy handling and positioning of the airfoils during the grit blasting process. Therefore, there is a need for an improved apparatus for supporting components, particularly airfoils of turbine engines in a grit blasting process.

SUMMARY OF THE INVENTION

One object of the present invention is to provide an apparatus for supporting at least one component in a grit blasting process.

In accordance with one aspect of the present invention, there is an apparatus provided for supporting at least one component in a grit blasting process, which comprises a base and a platform table assembly mounted to the base. The platform table assembly includes a platform table therein which is rotatable and angularly adjustable with respect to the base. The platform table includes a component holding device for releasably holding the at least one component in position during the grit blasting process.

In accordance with another aspect of the present invention, there is an apparatus provided for supporting a plurality of components in a grit blasting process, which comprises a base and a platform table assembly operatively mounted to the base. The platform table assembly includes an interchangeable component holding member detachably secured thereto. The interchangeable component holding member has a plurality of component holding elements adapted for holding selected components.

The apparatus of the present invention is advantageously of low cost for manufacturing and maintenance. The interchangeable component holding member advantageously provides easy loading and unloading of components, with the flexibility to support components of various sizes and profiles. Other features and advantages of the present invention will be better understood with reference to the preferred embodiments described hereinafter.

BRIEF DESCRIPTION OF THE DRAWINGS

Reference will now be made to the accompanying drawings showing by way of illustration a preferred embodiments, in which.

DETAILED DESCRIPTION OF THE PREFERRED EMBODIMENTS

Figure 1:
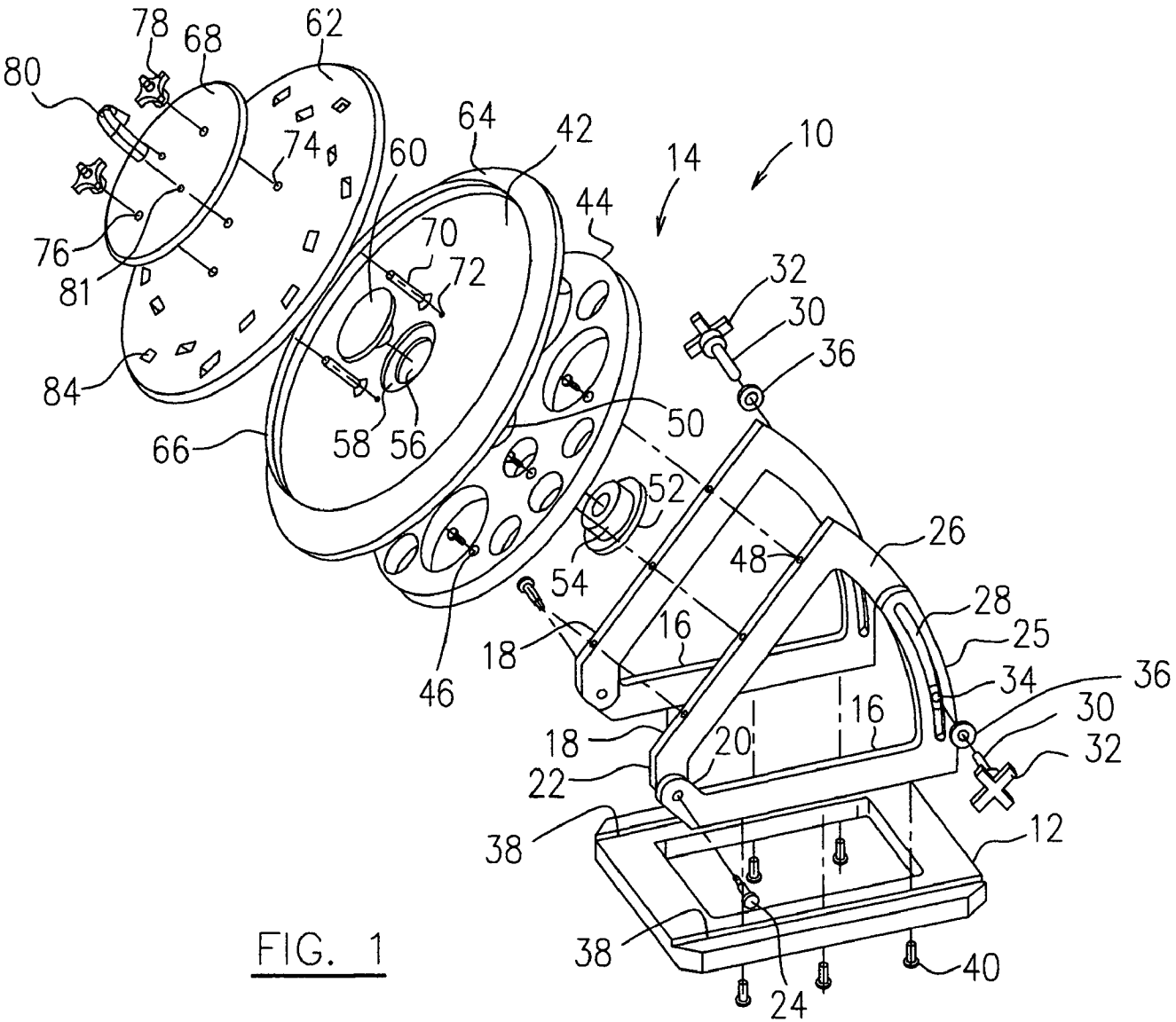
FIG. 1 is an exploded perspective view of a preferred embodiment of the present invention.
Figure 2:
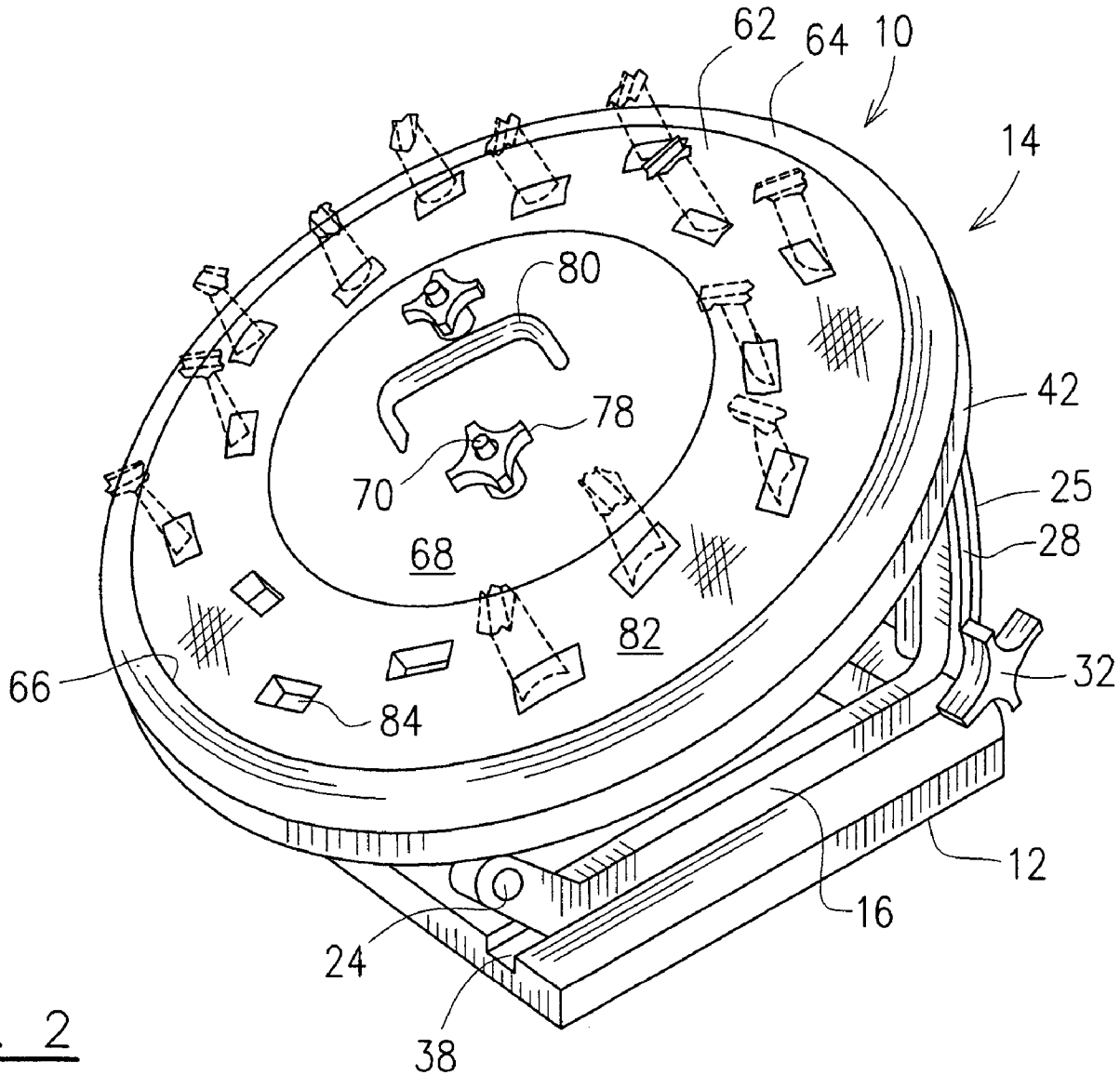
FIG. 2 is a perspective view of the preferred embodiment of FIG. 1, with a plurality of turbine stator vanes loaded thereon.

Referring to FIGS. 1 and 2, an apparatus generally indicated by numeral 10 according to one preferred embodiment of the present invention, includes a base 12 and a platform table assembly 14. The platform table assembly 14 includes at least one, but preferably a pair of bracket assemblies (not indicated) each including first and second bracket members 16 and 18. The bracket members 16, 18 at one end thereof have an end portion 20, 22, respectively, extending angularly and outwardly to be connected together by a bolt or pivot pin 24 such that the second bracket member 18 is pivotable about the pivot pin 24 with respect to the first bracket member 16. The bracket members 16, 18 at the other ends thereof include a curved end portion 25, 26, respectively, extending outwardly towards and overlapping each other such that the first and second bracket members 16, 18 together form an adjustable trianglular support.

A locking device (not indicated) is provided to lock the first and second bracket members 16, 18 in any selected triangular configuration. For example, a curved slot 28 is provided in the curved end portion 25 to allow a bolt 30 with a cross knob 32 to extend therethrough and engage with a nut 34 which is affixed to the curved end portion 26 of the second bracket member 18. A washer 36 is preferably provide for the bolt 30.

The base 12 is preferably a rectangular plate having a central aperture for reducing the weight thereof. A pair of parallel grooves 38 are provided on the top of the base 12 for receiving a bottom side of the respective first bracket members 16. The first bracket members 16 are secured in the grooves 38 in the base 12 by screws 40.

The platform table assembly 14 further includes a platform table 42 rotatably supported on a table support member, for example a support plate 44. The support plate 44 includes a plurality of mounting holes 46 for receiving mounting screws (not indicated) extending therethrough and secured in threaded mounting holes 48 in the respective second bracket members 18, in order to mount the support plate 44 to the bracket assembly.

The support plate 44 has a central opening 50 for accommodating a female connector 52. The female connector 52 includes a flange head (not indicated) with a sleeve section 54 which is preferably provided with inner threads. The platform table 42 has a central opening 56 including a counterbore 58. When the platform table 42 is placed on the support plate 44, the sleeve section 54 of the female connector 52 is inserted from the bottom side of the support plate 44 into the central opening 50 thereof, further extending into the central opening 56 of the platform table 42. The central opening 56 has an inner diameter slightly greater than the outer diameter of the sleeve section 54 of the female connector 52 such that the central opening 56 is guided around the sleeve section 54 of the female connector 52 when the platform table 42 is rotated on the support plate 44.

A threaded male connector 60 with a flat flange head (not indicated) is used to engage the inner thread of the female connector 52 and the flange heads of the respective female and male connectors 52, 60 in combination restrain the platform table 42 and the support plate 44 together, but permit rotation of the platform table 42. A screw locking device is preferably provided to prevent the secured female and male connectors 52, 60 from being loosened. For example, one or two pins (not shown) may be provided to insert through corresponding holes (not shown) through the female and male connectors 52, 60 in order to prevent relative rotation between the female and male connectors 52, 60. However, these pins should be positioned properly such that the pins engage the sleeve section 54 and are positioned not beyond the periphery of the sleeve section 54 of the female connector 52, in order to prevent interference with the rotation of the platform table 42 relative to the support plate 44.

The support plate 44 preferably includes a plurality of openings (not indicated) other than the central opening 50, in order to reduce the weight of the apparatus 10.

The platform table 42 is provided with a component holding member having a plurality of component holding elements adapted for holding selected components, respectively. For example, a mat of resilient material such as a rubber mat 62 is placed on a top surface of the platform table 42. The flange head of the male connector 60 is accommodated within the counterbore 58 of the platform table 42 and does not interfere with the positioning of the rubber mat 62 on the top surface of the platform table 42.

Both rubber mat 62 and the platform table 42 are preferably in a round shape. The platform table 42 preferably includes a continuous rim 64 around the outer periphery thereof and a continuous lip 66 extending radially and inwardly from the continuous rim 64. When the rubber mat 62 is placed on the top surface of the platform table 42, the outer periphery of the rubber mat 62 is retained by the continuous lip 66, in order to ensure that the rubber mat 62 is flatly positioned on the platform table 42.

The rubber mat 62 is releasably secured to the platform table 42 by means of a lock member, for example a plate 68, which is placed on the top at a central area of the rubber mat 62. Two bolts 70 are inserted from the bottom side of the platform table 42 through holes 72 in the platform table 42 and holes 74 in the rubber mat 62 and finally through holes 76 in the plate 68, and are secured by cross knobs 78, respectively. In order to conveniently position and remove the plate 68, a U-shaped handle 80 is affixed to the plate 68 by any well known means, for example by mounting screws (not shown) extending through mounting holes 81 in the plate 68.

The plate 68 is preferably in a round shape and has a diameter large enough to restrain (in combination with the lip 66 of the platform table 42) the rubber mat 62 on the platform table 42 when the rubber mat 62 is subjected to dynamic loads during the grit blasting process, but small enough to leave an annular area 82 of the rubber mat 62 (see FIG. 2) exposed to receive the components for processing.

In the annular area 82 of the mat 62, a plurality of profiled openings 84 is provided. These profiled openings 84 are especially sized and shaped to snuggly receive a part of the respective components such that the components can be easily loaded on and unloaded from the apparatus 10 and will be securely supported on the platform table 42 during a grit blasting process. For example, the profiled openings 84 in this embodiment are specially shaped and sized to snuggly receive a root portion of stator vane airfoils (shown in broken lines) of a gas turbine engine.

The root section of compressor blade airfoils are different from the root section of stator vane airfoils and the root section of airfoils in different stages of a gas turbine engine and for different engines vary, and therefore a rubber mat 62 with a selected profile openings 84 is adapted for holding only one selected type of airfoils. Therefore, the rubber mat 62 is interchangeable such that rubber mats having various profiled openings 84 can be selected for use with a particular group of airfoils to be processed.

During a grit blasting operation the appropriate rubber mat 62 is selected. The selected rubber mat 62 includes the profiled openings 84 corresponding to the root section of the airfoils to be processed. The plate 68 is removed by unscrewing the two cross knobs 78 thereby releasing a previously installed rubber mat which can then be removed and replaced by the appropriate rubber mat 62 with selected profiled openings 84. After the selected rubber mat 62 is secured on the platform table 42 by placing the plate 62 thereon and tightening the cross knobs 78, the airfoils to be processed are loaded on the platform table 42 by insertion of the respective root sections of the airfoils into the profiled openings 84 of the selected rubber mat 62.

The apparatus 10 can then be angularly adjusted to position the airfoils to be processed in an optimum angular position during the process. In order to achieve the angular adjustment, cross knobs 32 are loosened slightly to permit the second bracket members 18 to pivot about the pivot pins 24 with respect to the first bracket members 16. When the platform table 42 with the loaded airfoils to be processed reaches the optimum angular position for processing, the cross knobs 32 are tightened to lock this angular position of the first and second bracket members 16, 18.

After the angular adjustment is completed, the apparatus 10 with the loaded airfoils to be processed is placed inside the blast process cabinet (not shown). An operator holds the rotatable platform table 42 and controllably rotates same with one hand during the grit blasting process, while holding a blasting nozzle with the other hand to blow an abrasive air jet onto the surfaces of the airfoils to be processed. After the process is completed the apparatus 10 with the loaded airfoils which have been processed is taken out of the blast process cabinet and the airfoils having been processed are conveniently unloaded from the apparatus by simply pulling same away from the rubber mat 62.

The apparatus 10 is then ready for the next batch of airfoils to be processed. If the next batch of airfoils to be processed are of a different configuration than the batch of airfoils having just been processed, the rubber mat 62 installed on the platform table 42 must be replaced by another rubber mat which is selected to have the profiled openings thereof corresponding with the root sections of the next batch of airfoils to be processed.

Figure 3:
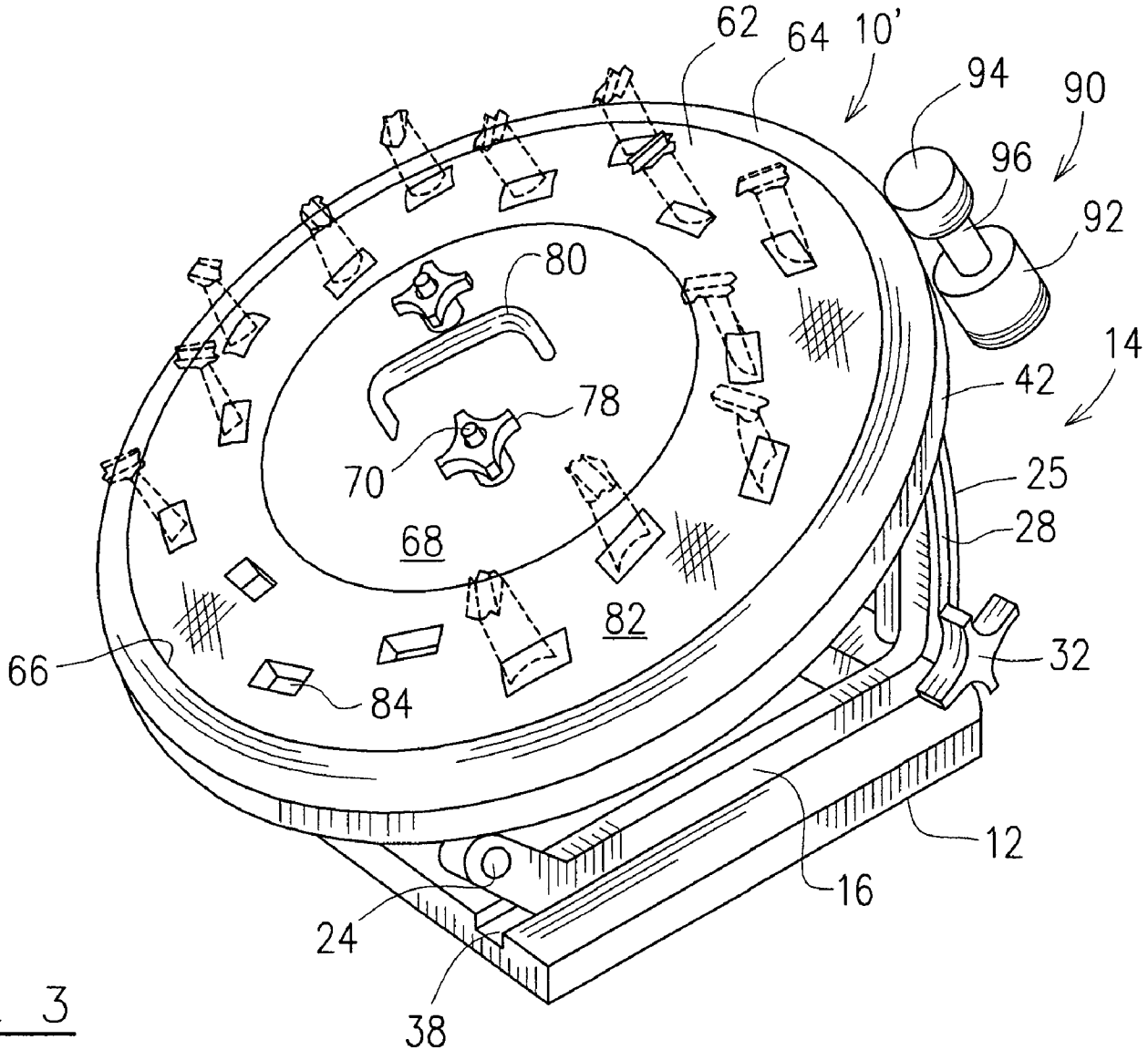
FIG. 3 is a perspective view of another embodiment of the present invention which is driven by a motor during use.

FIG. 3 illustrates an apparatus 10' for supporting a plurality of components in a grit blasting process in accordance with another preferred embodiment of the present invention. The apparatus 10' is similar to the apparatus 10 in FIGS. 1 and 2, and similar components which are indicated by similar reference numerals will not therefore be redundantly described.

The apparatus 10' further includes a power driver 90 such that the rotation of the platform table 42 is conducted automatically and controllably by the power driver 90 rather than being manually conducted by an operator's hand. The power driver 90 can be any well known power driving means. For example, the power driver 90 in this embodiment includes a power motor 92 which can be selected from an electric motor, hydraulic fluid motor, pneumatic motor, etc. The motor 92 is preferably supported on the support plate 44 or on the second bracket members 18 (see FIG. 1) such that the motor 90 is adapted to maintain a parallel position with respect to a center line (not shown) of the platform table 42 when an angular adjustment of apparatus 10' is required. The supporting structure (not shown) can be any well known configuration such as brackets, frames, etc. A rubber roller 94 is affixed to a rotating shaft 96 of the motor 92 and is adapted to rotate together with the shaft 96. The rubber roller 94 firmly contacts the outer periphery of the rotatable platform table 42 to cause rotation of the platform table 42 via frictional forces therebetween when the rubber roller 94 is rotated together with the motor shaft 96.

The motor and rubber roller configuration shown in FIG. 3 as an example of any driving mechanisms to illustrate that this invention can be applied either manually or automatically without departing from the spirit of the invention.

The material used for the apparatus can various types such as metal or plastics, however the choice of material must take into consideration the need to withstand the abrasive environment of the grit blasting process and is preferably of a lightweight material for the convenience of handling the apparatus.

It should be understood that the rotation and angular adjustment functions of the platform table with respect to the base, can be achieved by various designs and the particular embodiments described above are considered to be examples to illustrate the principle of the invention.

The advantages of the present invention lie in the convenience of loading and unloading, and the handling and positioning of the components for the grit blasting process, thereby resulting in process efficiencies and work productivity. Further advantages of the present invention are the relatively simple configuration which results in a low cost of manufacturing and maintenance, reliability of operation and convenience of transportation. The interchangable rubber mat of the apparatus provides a flexibility of the apparatus for various types of components.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

I claim:

1. An apparatus for supporting at least one component in a grit blasting process comprising a base, and a platform table assembly mounted to the base and including a platform table therein rotatable with respect to the base, the platform table including a resilient member disposed on a supporting surface of the platform table, for releaseably holding a portion of the at least one component in position during the grit blasting process, the platform table being angularly adjustable to change the orientation of the supporting surface of the platform table relative to the base.

2. An apparatus as claimed in claim 1 wherein the platform table assembly comprises a table support member angularly and adjustably mounted to the base, the platform table being rotatably mounted to the table support member.

3. An apparatus as claimed in claim 2 wherein the platform table assembly comprises at least one bracket assembly including first and second bracket members, the first bracket member being affixed to the table support member, the second bracket member being affixed to the base and the first and second bracket members being pivotally jointed such that the first bracket member is angularly moveable with respect to the second bracket member.

4. An apparatus as claimed in claim 3 wherein the at least one bracket assembly comprises a lock device adapted to lock the second bracket member in a selected angular position with respect to the first bracket member.

5. An apparatus as claimed in claim 1 wherein the platform table assembly comprises a motor for driving the platform table to rotate.

6. An apparatus as claimed in claim 1 wherein the resilient member is configured to retain a plurality of components in respective positions spaced apart one from another.

7. An apparatus as claimed in claim 1 wherein the component holding device comprises means for releaseably securing the resilient member to the platform table such that the resilient member is substitutable by another resilient member adapted to hold a component of different configuration or size.

8. An apparatus for supporting a plurality of components in a grit blasting process comprising a base, and a platform table assembly operatively mounted to the base, the platform table assembly including a detachable component holding member detachably secured thereto, the detachable component holding member including a resilient mat positioned on the platform table to define a plurality of mating openings into which the components are inserted and snugly retained therein, the platform table assembly further including a lock member positioned on the top of the resilient mat and detachably connected to the platform table.

9. An apparatus as claimed in claim 8 wherein the platform table assembly comprises a platform table rotatable with respect to the base.

10. An apparatus as claimed in claim 8 wherein the platform table assembly comprises a platform table angularly adjustable with respect to the base.

11. An apparatus as claimed in claim 8 wherein the selectively mating openings are defined for snugly receiving a root end of respective airfoils of a turbine engine.

12. An apparatus as claimed in claim 8 wherein the resilient mat is substitutable by another resilient mat defining mating openings for snugly retaining components of different configurations or size.

13. An apparatus as claimed in claim 8 wherein the platform table comprises a continuous lip for retaining an outer periphery of the resilient mat.

14. An apparatus for retaining turbine blades during a blasting process, the blades having airfoils extending from a base, the apparatus comprising a support, a table and a fixing member, the table having a resilient portion including a plurality of openings therein, each opening being adapted to snugly receive a blade base, the table being angularly adjustable to change orientational positions of an opening defining surface of the resilient portion relative to the support, the fixing member being adapted to selectively affix the position of the table relative to the support.

15. An apparatus as defined in claim 14 wherein the resilient portion is removable for replacement by a replacement resilient portion adapted to receive a blade base of different size.

* * * * *